US009347670B2

(12) United States Patent
Cadima

(10) Patent No.: US 9,347,670 B2
(45) Date of Patent: May 24, 2016

(54) BURNER ASSEMBLY FOR AN APPLIANCE

(76) Inventor: Paul Bryan Cadima, Prospect, KY (US)

( * ) Notice: Subject to any disclaimer, the term of this patent is extended or adjusted under 35 U.S.C. 154(b) by 807 days.

(21) Appl. No.: 13/476,105

(22) Filed: May 21, 2012

(65) Prior Publication Data

US 2013/0306055 A1 Nov. 21, 2013

(51) Int. Cl.

| | |
|---|---|
| ***F24C 3/00*** | (2006.01) |
| ***F24C 3/08*** | (2006.01) |
| ***F24C 3/10*** | (2006.01) |

(52) U.S. Cl.
CPC .. *F24C 3/085* (2013.01); *F24C 3/10* (2013.01)

(58) Field of Classification Search
CPC ..... F24C 3/08; F24C 3/082; F24C 3/085
USPC .... 126/39 E, 39 R, 39 H, 39 B; 431/198, 266
See application file for complete search history.

(56) References Cited

U.S. PATENT DOCUMENTS

| | | | | |
|---|---|---|---|---|
| 5,046,477 | A * | 9/1991 | Bennett et al. | 126/39 B |
| 5,924,860 | A * | 7/1999 | Massey et al. | 431/266 |
| 6,170,479 | B1 | 1/2001 | Taplan | |
| 6,299,436 | B1 * | 10/2001 | Huang | F23D 14/06 126/39 R |
| 6,817,355 | B1 * | 11/2004 | Hawkins | F24C 3/085 126/214 A |
| 2010/0206293 | A1 * | 8/2010 | Padgett | F23D 14/06 126/39 E |

* cited by examiner

*Primary Examiner* — Avinash Savani
*Assistant Examiner* — Vivek Shirsat
(74) *Attorney, Agent, or Firm* — Dority & Manning, P.A.

(57) ABSTRACT

A burner assembly for an appliance is provided. The appliance includes a top panel constructed of a non-conducting material. A gas burner is removably mounted to the top panel at an opening of the top panel. A conducting contact extends between the gas burner and a mounting assembly positioned at the opening of the top panel. The conducting contact can be used to ground the gas burner.

19 Claims, 3 Drawing Sheets

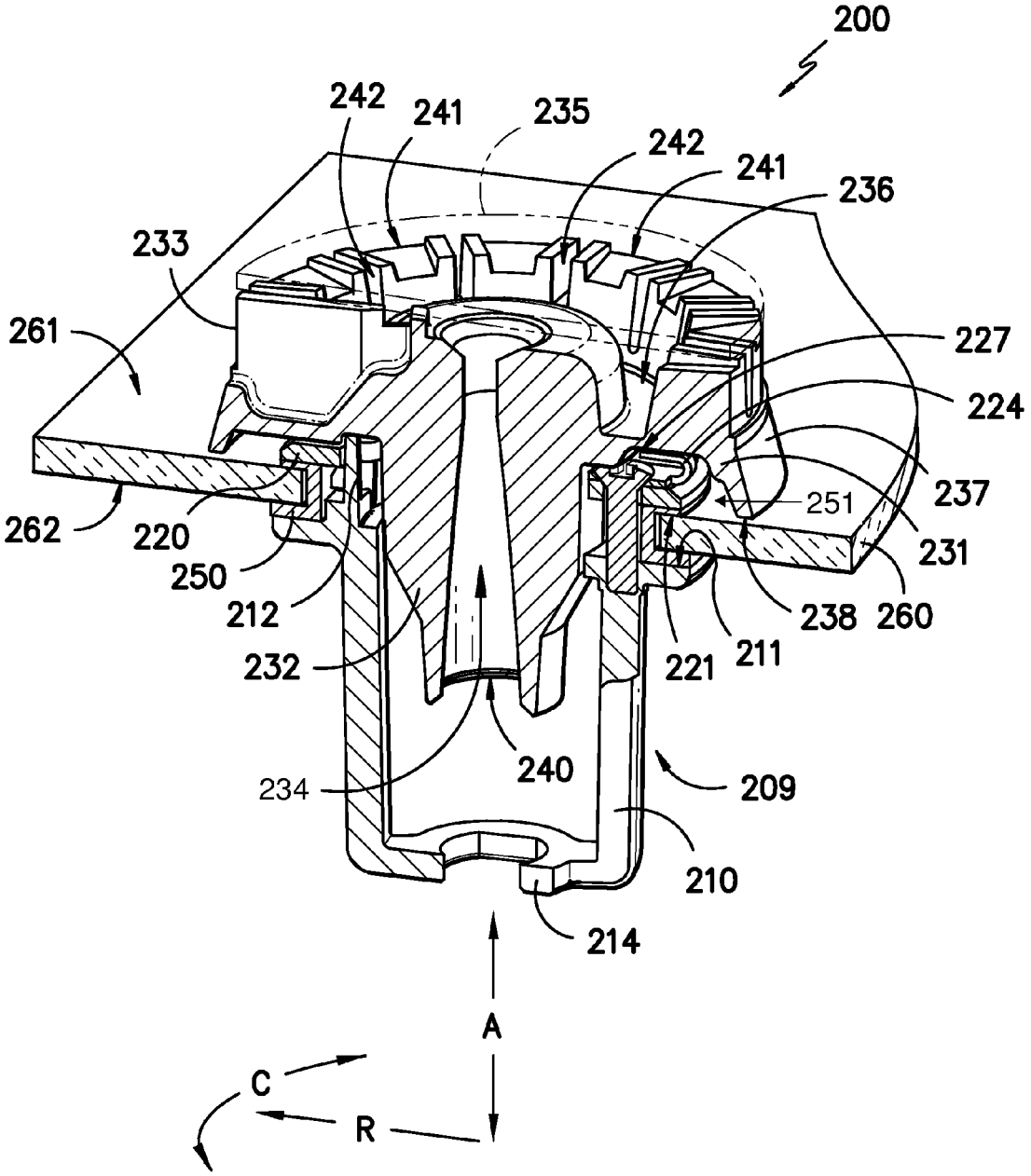
FIG. –3–

BURNER ASSEMBLY FOR AN APPLIANCE

FIELD OF THE INVENTION

The present subject matter relates generally to gas burners, e.g., as may be used in a cooktop appliance or a range appliance.

BACKGROUND OF THE INVENTION

Generally, gas cooktop appliances include a plurality of gas burners mounted to a top surface of the appliance. To light the gas burners, certain cooktop appliances include an ignition device. The ignition device can create an electrical arc that ignites gaseous fuel flowing through the gas burner. In particular, the ignition device can create an electrical arc between the ignition device and the gas burner to ignite the gaseous fuel.

Generally, the gas burner must be grounded for the ignition device to create an electric arc between the ignition device and the gas burner. In certain cooktop appliances, the gas burner is electrically grounded when the burner is mounted to the top surface of the cooktop appliance. For example, the top surface of certain cooktop appliances is constructed of a conductive metal that is in contact with a ground. Thus, by grounding the top surface of the cooktop, the gas burner is grounded as well. However, certain cooktop appliances have a top surface that is constructed of a non-conductive material such as a ceramic material or enameled steel. As a result, simply mounting the gas burner to the top surface will not ground the gas burner.

In addition, gas burners that are removable for easy cleaning are generally mounted to the cooktop appliance so that there is a gap between the top surface of the cooktop appliance and a head of the gas burner, i.e.—the gas burner's head floats above the top surface of the cooktop appliance when the gas burner is mounted to the cooktop appliance. This is to ensure the burner head is always in electrical communication with a grounded component of the burner assembly. Such an arrangement has several drawbacks. For example, the gap can have an unpleasant cosmetic appearance to consumers. Also, during use of the cooktop, spills and overflows can lead to food particles accumulating on the top surface of the cooktop. Such food particles can flow or travel beneath the gas burner and be difficult to clean and/or remove. Such food particles or liquid spills can also interfere with grounding of the gas burner.

Accordingly, a gas burner with features for grounding the gas burner when the gas burner is mounted to a non-conductive surface would be useful. Also, a gas burner with features for easily cleaning beneath the gas burner would be useful. Further, a gas burner with features for impeding debris from collecting beneath the gas burner would be useful. In addition, a gas burner that mounts to a cooking surface without a gap between the gas burner and the cooking surface would be useful.

BRIEF DESCRIPTION OF THE INVENTION

The present subject matter provides a burner assembly for an appliance. The appliance includes a top panel constructed of a non-conducting material. A gas burner is removably mounted to the top panel at an opening of the top panel. A conducting contact extends between the gas burner and a mounting assembly positioned at the opening of the top panel. The conducting contact can be used to ground the gas burner. Additional aspects and advantages of the invention will be set forth in part in the following description, or may be obvious from the description, or may be learned through practice of the invention.

In a first exemplary embodiment, an appliance is provided. The appliance includes a panel having an upper surface and a lower surface. The panel is constructed of a non-conductive material. The panel also defines an opening. A mounting assembly is fixed to the panel at the opening of the panel. A gas burner is removably inserted into the opening of the panel. The gas burner has a support that extends downwardly from the gas burner to the top surface of the panel. A conducting contact extends between the mounting assembly and the gas burner. The contact places the mounting assembly and the gas burner in electrical communication.

In a second exemplary embodiment, an appliance is provided. The appliance includes a panel having an upper surface and a lower surface. The panel is constructed of a non-conductive material. The panel also defines an opening. A mounting assembly is fixed to the panel at the opening of the panel. The mounting assembly includes an upper bracket having a bottom surface facing and positioned adjacent the upper surface of the panel. A bottom bracket is coupled to the upper bracket. The bottom bracket has a top surface facing and positioned adjacent the lower surface of the panel. A burner assembly is removably received within the opening of the panel. The burner assembly includes a burner body and a support extending downwardly from the burner body to the top surface of the panel. A conducting contact extends between the mounting assembly and the burner assembly. The contact places the mounting assembly and the burner assembly in electrical communication.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 provides a cross-sectional view of the burner assembly of FIG. 2.

DETAILED DESCRIPTION OF THE INVENTION

Figure 1:
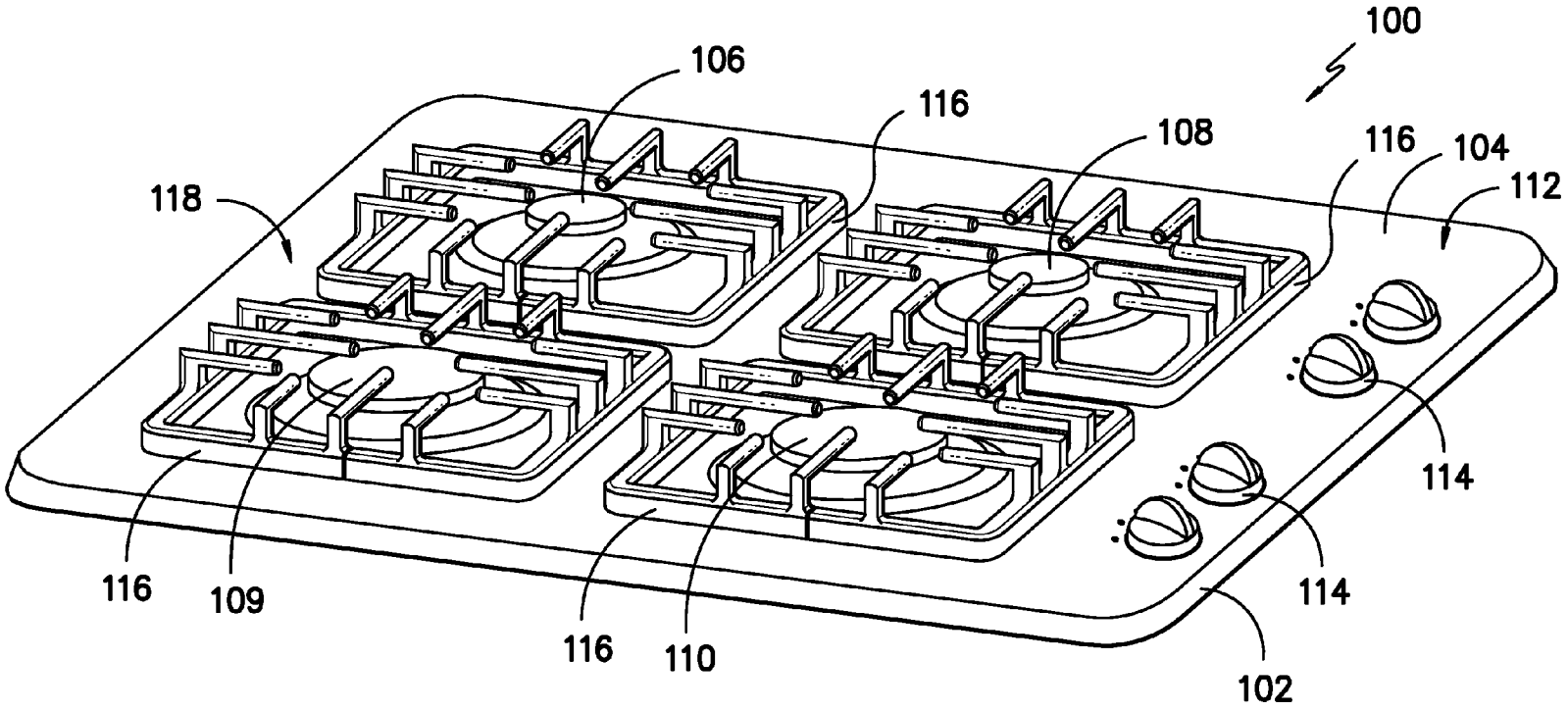
FIG. 1 provides a perspective view of a cooktop appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. Cooktop appliance 100 includes a non-conducting material 102 that provides a top panel 104. As will be understood by those skilled in the art and as used herein, "non-conducting" describes materials which support only insignificant or slight electric currents relative to a conducting material. Thus, non-conducting material 102 may permit a small amount of electrical conduction. By way of example, non-conducting material 102 may include glass, ceramics, enameled steel, and combinations thereof.

For cooktop appliance 100, a utensil holding food and/or cooking liquids (e.g., oil, water, etc.) is placed onto grates 116 at a location of any of burner assemblies 106, 108, 109, and 110. As shown in FIG. 1, burners assemblies 106, 108, 109, and 110 can be configured in various sizes so as to provide e.g., for the receipt of cooking utensils (i.e., pots, pans, etc.) of various sizes and configurations and to provide different heat inputs for such cooking utensils. Grates 116 are supported on a top 118 of top panel 104.

Burner assemblies 106, 108, 109, and 110 provide thermal energy to cooking utensils on grates 116. In particular, burner assemblies 106, 108, 109, and 110 extend through top panel 104 below grates 116. Burner assemblies 106, 108, 109, and 110 are mounted to top panel 104 as described in greater detail below.

A user interface panel 112 is located within convenient reach of a user of the cooktop appliance 100. For this exemplary embodiment, panel 112 includes knobs 114 that are each associated with one of burner assemblies 106, 108, 109, and 110. Knobs 114 allow the user to activate each burner assembly and determine the amount of heat input provided by each burner assembly 106, 108, 109, and 110 to a cooking utensil located thereon. Panel 112 may also be provided with one or more graphical display devices that deliver certain information to the user such as e.g., whether a particular heating source is activated and/or the level at which the element is set.

Operation of cooktop appliance 100 can be regulated by a controller (not shown) that is operatively coupled i.e., in communication with, user interface panel 112 and burner assemblies 106, 108, 109, and 110. For example, in response to user manipulation of the knobs 114 of user interface panel 112, the controller operates one of burner assemblies 106, 108, 109, and 110. By way of example, the controller may include a memory and one or more processing devices such as microprocessors, CPUs or the like, such as general or special purpose microprocessors operable to execute programming instructions or micro-control code associated with operation of cooktop appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout cooktop appliance 100. In the illustrated embodiment, the controller may be located under or next to the user interface panel 112. In such an embodiment, input/output ("I/O") signals are routed between the controller and various operational components of cooktop appliance 100 such as burner assemblies 106, 108, 109, and 110, controls 114, sensors, graphical displays, and/or one or more alarms. In one embodiment, the user interface panel 112 may represent a general purpose I/O ("GPIO") device or functional block.

Although shown with knobs 114, it should be understood that controls 114 and the configuration of cooktop appliance 100 shown in FIG. 1 is provided by way of example only. More specifically, user interface 112 may include various input components, such as one or more of a variety of touch-type controls, electrical, mechanical or electro-mechanical input devices including rotary dials, push buttons, and touch pads. The user interface 112 may include other display components, such as a digital or analog display device designed to provide operational feedback to a user. The user interface 112 may be in communication with the controller via one or more signal lines or shared communication busses.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in other appliances, e.g., range appliances having cooktop burners.

Figure 2:
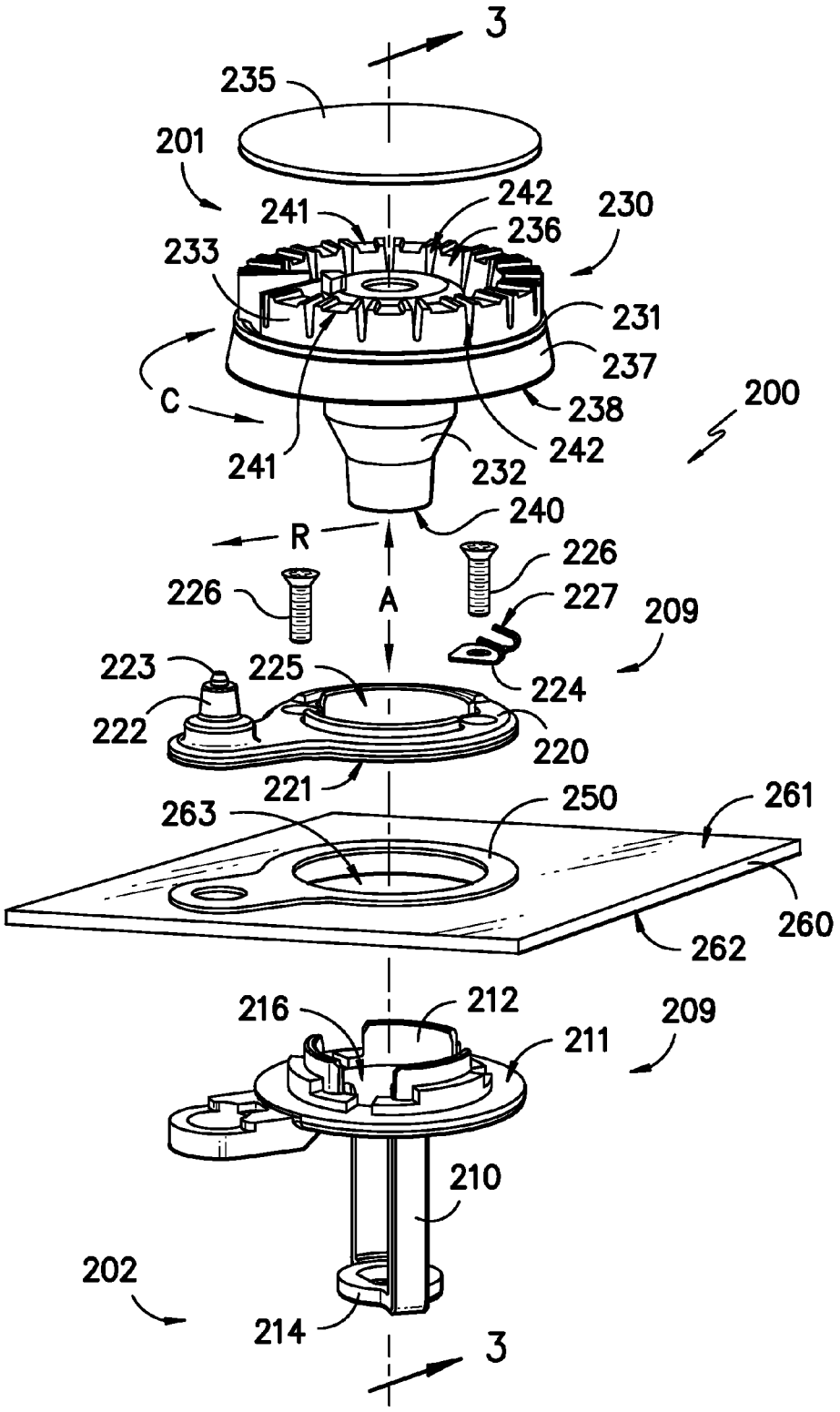
FIG. 2 illustrates an exploded view of a burner assembly according to an exemplary embodiment of the present subject matter.

FIG. 2 illustrates an exploded view of a burner assembly 200 according to an exemplary embodiment of the present subject matter. FIG. 3 provides a cross-sectional view of burner assembly 200. Burner assemblies 106, 108, 109, and 110 (FIG. 1) may be constructed in the same or a substantially similar manner to burner assembly 200. Burner assembly 200 defines a radial direction shown with arrow R, an axial direction shown with arrow A, and a circumferential direction shown with arrow C.

As discussed above, burner assembly 200 is shown in FIG. 2 in an exploded configuration. In FIG. 2, burner assembly 200 is configured for mounting to a panel 260 (e.g., top panel 104 shown in FIG. 1) that is constructed of a non-conducting material. Panel 260 includes an upper surface 261 and a lower surface 262. Upper and lower surfaces 261 and 262 are spaced apart, e.g., along the axial direction A. Panel 260 defines an opening 263 that extends through panel 260 between upper surface 261 and lower surface 262 along axial direction A. As may be seen in FIG. 3, in the assembled configuration, burner assembly 200 is mounted to panel 260 at opening 263 (FIG. 2) and extends through opening 263. A gasket 250 is disposed within opening 263 and assists with mounting burner assembly 200 and preventing spills on panel 260 from entering opening 263.

Turning back to FIG. 2, burner assembly 200 includes a mounting assembly 209. Mounting assembly 209 includes a top bracket 220 and a bottom bracket 210. Top bracket 220 has a bottom surface 221. In the assembled configuration shown in FIG. 3, bottom surface 221 of top bracket 220 faces upper surface 261 of panel 260 and is positioned adjacent upper surface 261 of panel 260 (e.g., on gasket 250). Top bracket 220 also defines an opening 225 (FIG. 2).

As may be seen in FIG. 2, an igniter 222 is mounted to top bracket 220. Igniter 222 is in electrical communication with an electrical source (not shown, e.g., a power supply of the controller described above) such that igniter 222 selectively creates, carries, or directs a voltage differential, e.g., between a tip 223 of igniter 222 and another component of burner assembly 200. The voltage differential can create an electrical arc that ignites gaseous fuel within burner assembly 200 as discussed in greater detail below.

Bottom bracket 210 has a top surface 211. In the assembled configuration shown in FIG. 3, top surface 211 of bottom bracket 210 faces lower surface 262 of panel 260 and is positioned adjacent lower surface 262 of panel 260 (e.g., on gasket 250). A collar 212 extends from top surface 211 of bottom bracket 210 along axial direction A. Collar 212 is shaped and sized for receipt within opening 263 of panel 260. In particular, in the assembled configuration shown in FIG. 3, collar 212 is disposed within opening 263 of panel 260. Collar 211 may prevent displacement of mounting assembly 209 along the radial direction R in the assembled configuration shown in FIG. 3.

Bottom bracket 210 further includes a gas line support 214 disposed below top surface 211 of bottom bracket 210 along axial direction A. Gas line support 214 may receive and support tubing or a conduit (not shown). As is understood by those skilled in the art, such tubing can direct a flow of gaseous fuel (e.g., LP or natural gas) from a fuel source (not shown) to burner assembly 200. Bottom bracket 210 also defines an opening 216 (FIG. 2).

Top bracket 220 and bottom bracket 210 may be selectively coupled together with fasteners 226. In the assembled configuration shown in FIG. 3, top bracket 220 is positioned on upper surface 261 of panel 260 and lower bracket 210 is positioned on lower surface 262 of panel 260. Fasteners 226 extend through top bracket 220 into lower bracket 210 and fix upper and lower brackets 220 and 210 together.

Burner assembly 200 also includes a gas burner 230. As may be seen in FIG. 3, gas burner 230 is removably inserted into opening 263 (FIG. 3) of panel 260. To permit gas burner 230 to be received by opening 263 of panel 260, opening 216 (FIG. 3) of lower bracket 210 and opening 225 (FIG. 3) of bottom bracket 220 are aligned with opening 263 of panel 260 in the assembled configuration.

As may be seen in FIG. 3, in the assembled configuration, a user can remove gas burner 230 from opening 263 of panel 260 by simply lifting upwardly on gas burner 230 along the axial direction A. Such a configuration permits easy cleaning of upper surface 261 of panel 260 beneath gas burner 230. Thus, for example, if a liquid is spilled on panel 260 and such liquid flows beneath gas burner 230, a user can remove gas burner 230 and clean the spill, e.g., without needing tools to remove the gas burner 230. After cleaning, the user can simply reinsert gas burner 230 into opening 263 of panel 260 to reassemble gas burner assembly 200, again without tools.

Gas burner 230 includes a burner head or body 231. A sleeve 232 extends downwardly from burner body 231 along axial direction A. Sleeve 232 is configured for receipt within opening 263 of panel 260 as discussed above. A sidewall 233 extends upwardly from burner body 231 along axial direction A. Sidewall 233 extends along circumferential direction C about an edge of gas burner 230. Sidewall 233 defines a plurality of outlets 241 and a plurality of outlets 242. Burner assembly 200 also includes a cover 235. As may be seen in FIG. 3, in the assembled configuration, cover 235 sits on gas burner 230 (e.g., sidewall 233 of gas burner 230) to form a chamber 236.

As may be seen in FIG. 3, gas burner 230 (e.g., sleeve 232) defines a conduit 234 for directing gaseous fuel and air from the fuel source described above to chamber 236 of gas burner 230. In particular, gas burner 230 defines an inlet 240 that may receive gaseous fuel and air mixture from the tubing and the fuel source described above. Such gaseous fuel and air mixture is directed through conduit 234 to chamber 236. From chamber 236, such gaseous fuel and air mixture then flows out of chamber 236 through plurality of outlets 241 and 242. Upon exiting plurality of outlets 241 and 242, such air and gaseous fuel mixture can be combusted to generate heat for cooking as described above.

Gas burner 230 further includes a support 237 that extends downwardly from burner body 231 along axial direction A. Support 237 may be constructed as a flange that extends about gas burner 230 along circumferential direction C as shown in FIGS. 2 and 3. Support 237 has a distal end 238 that is spaced apart from burner body 231 along the axial direction A. As may be seen in FIG. 3, in the assembled configuration, support 237 extends between burner body 231 and panel 260. Thus, support 237 rests on panel 260, e.g., on upper surface 261 of panel 260. In particular, distal end 238 of support 237 is positioned immediately adjacent (e.g., on) upper surface 261 of panel 260. Thus, gas burner 230 is supported on panel 260 by support 237 in the assembled state.

By resting on panel 260, support 237 prevents a gap from forming between distal end 238 of support 237 and upper surface 261 of panel 260. Such a gap can have an unpleasant cosmetic appearance to a user and also permit debris to accumulate beneath the gas burner 230. Thus, by resting on panel 260, support 237 can support gas burner 230, prevent debris from collecting under gas burner 230, and provide a pleasant aesthetic appearance to a user.

Burner assembly 200 also includes a (e.g., compliant) conducting contact 224 such as a clip, spring, or probe. Conducting contact 224 is configured to extend between mounting assembly 209 and gas burner 230 in order to place the two components in electrical communication. In particular, tubing to the fuel supply described above may be grounded. Thus, mounting assembly 209 is also grounded because such tubing is fixed to gas line support 214. Similarly, because conducting contact 224 extends between mounting assembly 209 and gas burner 230, gas burner 230 is grounded as well. Such a configuration allows igniter 222 to create an electrical arc between tip 223 of igniter 222 and gas burner 230 because gas burner 230 is grounded. In turn, the electrical arc created by igniter 222 can ignite gaseous fuel flowing through gas burner 230 as described above.

To permit grounding of gas burner 230 as described above, mounting assembly 209, conducting contact 224, and gas burner 230 are constructed of a conducting material. As an example, conducting material may include a metal such as aluminum, steel, or cast iron. In the exemplary embodiment shown in FIG. 3, conducting contact 224 is mounted to top bracket 220 with fastener 226. In alternative exemplary embodiments, conducting contact 224 may be mounted at any suitable location within burner assembly 200 using any suitable mechanism. For example, conducting contact 224 may be welded or soldered to bottom bracket 210 or gas burner 230. Also, as may be seen in FIG. 3, conducting contact 224 is mounted to top bracket 220 and is received within a cavity 251 defined by gas burner 230 (e.g., burner body 231 of gas burner 230). However, conducting contact 224 may contact any other portion of gas burner 230, e.g., sleeve 232 of gas burner 230.

Conducting contact 224 is cantilevered away from top bracket 220 such that conducting contact 224 bends elastically when gas burner 230 is received within opening 263 of panel 260. In particular, a head 227 of conducting contact 224 is urged towards gas burner 230 by elastic bending of conducting contact 224 when gas burner 230 is received within opening 263 of panel 260. Thus, as will be understood by those skilled in the art, conducting contact 224 will continue to extend between and electrically connect mounting assembly 209 and gas burner 230 despite minor variations within tolerances between the two components due to elastic bending of conducting contact 224.

As an example, gas burner 230 will be displaced away from mounting assembly 209 if debris becomes lodged between distal end 238 of support 237 and upper surface 261 of panel 260. Similarly, gas burner 230 will expand and change dimensions when gas burner 230 is heated by combustion of gaseous fuel. Further, gas burner 230 may be constructed using casting techniques that have poor tolerances between different castings. In such situations, conducting contact 244 can ground gas burner 230 within a range of tolerances because head 227 of conducting contact 224 is urged towards gas burner 230 by elastic bending of conducting contact 224.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:

a panel having an upper surface and a lower surface, said panel constructed of a non-conductive material, said panel defining an opening;

a mounting assembly fixed to said panel at the opening of said panel, said mounting assembly having a gas line support;

a gas burner removably inserted into the opening of said panel such that said gas burner is not fixed to said mounting assembly and is also positioned for receiving fuel from a conduit on the gas line support of said mounting assembly, said gas burner having a support that extends downwardly from a burner body of said gas burner to the top surface of said panel such that the support of said gas burner contacts the top surface of said panel and said gas burner is supported on said panel above the top surface of said panel by the support of said gas burner, the support extending about the burner body at an outer edge of the burner body, the support integrally formed with the burner body, said gas burner also defining a cavity between the top surface of the panel and an inner surface of the support; and a compliant conducting contact elastically deformed such that said conducting contact extends between said mounting assembly and said gas burner in the cavity of said gas burner, said conducting contact placing said mounting assembly and said gas burner in electrical communication.

2. The appliance of claim 1, further comprising a spark igniter positioned adjacent said gas burner, said igniter selectively carrying a voltage differential between said igniter and said gas burner.

3. The appliance of claim 1, wherein said non-conductive material is a ceramic or an enameled steel.

4. The appliance of claim 1, wherein said mounting assembly is grounded.

5. The appliance of claim 1, wherein said conducting contact is fixed to said mounting assembly.

6. The appliance of claim 5, wherein said conducting contact extends from said mounting assembly into the cavity defined by said burner body.

7. The appliance of claim 1, wherein said conducting contact is fixed to said gas burner.

8. The appliance of claim 1, wherein the appliance is a cooktop appliance.

9. The appliance of claim 1, wherein the appliance is a range appliance.

10. An appliance comprising:

a panel having an upper surface and a lower surface, said panel constructed of a non-conductive material, said panel defining an opening;

a mounting assembly fixed to said panel at the opening of said panel, said mounting assembly comprising:

an upper bracket having a bottom surface facing and positioned adjacent the upper surface of said panel; and a bottom bracket coupled to said upper bracket, said bottom bracket having a top surface facing and positioned adjacent the lower surface of said panel, said bottom bracket having a gas line support;

a burner assembly removably received within the opening of said panel such that said burner assembly is not fastened to said bottom bracket, said burner assembly comprising:

a burner body;

a sleeve extending downwardly from said burner body into the opening of said panel, said sleeve defining a conduit for directing gaseous fuel received from a conduit on the gas line support to said burner body;

a support extending downwardly from said burner body to the top surface of said panel such that said burner body is spaced apart from the top surface of said panel by said support, said support extending about said burner body at an outer edge of said burner body, said support integrally formed with said burner body and said sleeve, said support spaced apart from said sleeve by a cavity defined between said support and said sleeve; and a compliant conducting contact extending between said mounting assembly and said burner assembly in the cavity, said conducting contact placing said mounting assembly and said burner assembly in electrical communication.

11. The appliance of claim 10, further comprising an igniter mounted to said upper bracket, said igniter selectively carrying a voltage differential between said igniter and said burner assembly.

12. The appliance of claim 10, wherein said non-conductive material is a ceramic or an enameled steel.

13. The appliance of claim 10, wherein said mounting assembly is grounded.

14. The appliance of claim 10, wherein said conducting contact is mounted to said upper bracket.

15. The appliance of claim 14, wherein said conducting contact extends from said upper bracket into the cavity defined by said burner body.

16. The appliance of claim 10, wherein said conducting contact is mounted to said bottom bracket.

17. The appliance of claim 10, wherein said conducting contact is mounted to said burner assembly.

18. The appliance of claim 10, wherein the appliance is a cooktop appliance.

19. The appliance of claim 10, wherein the appliance is a range appliance.

* * * * *